US005799582A

United States Patent [19]

Rudibaugh et al.

[11] Patent Number: 5,799,582

[45] Date of Patent: Sep. 1, 1998

[54] BEARING ADAPTER AND ADAPTER PAD FOR RAILWAY TRUCKS

[75] Inventors: John W. Rudibaugh, West Chester; Charles L. Van Auken, Dillsburg, both of Pa.

[73] Assignee: Pennsy Corporation, Westchester, Pa.

[21] Appl. No.: 769,941

[22] Filed: Dec. 19, 1996

[51] Int. Cl.[6] ..... B61F 5/26

[52] U.S. Cl. ..... 105/222; 105/224.1; 105/225

[58] Field of Search ..... 105/218.1, 220, 105/221.1, 222, 224.1, 225

[56] References Cited

U.S. PATENT DOCUMENTS

| | | | |
|---|---|---|---|
| 3,381,629 | 5/1968 | Jones | 105/218.1 |
| 3,785,298 | 1/1974 | Reynolds | 105/218.1 |
| 4,363,278 | 12/1982 | Mulcahy | 105/218.1 |
| 4,785,740 | 11/1988 | Grandy | 105/225 |
| 5,261,332 | 11/1993 | Grandy | 105/218.1 |
| 5,404,826 | 4/1995 | Rudibaugh et al. | 105/222 |
| 5,562,045 | 10/1996 | Rudibaugh et al. | 105/224.1 |

*Primary Examiner*—S. Joseph Morano
*Attorney, Agent, or Firm*—Banner & Witcoff Ltd.

[57] ABSTRACT

An improved adapter assembly for use in a railcar truck where an axle and bearing are loosely journaled in the pedestal area of a side frame, the adapter assembly being mounted above the bearing in the pedestal opening and including a novel adapter and a novel adapter pad which is mounted on top of the adapter, the adapter together with the bearing, axle and wheels being capable of predetermined lateral movement relative to the side frame.

12 Claims, 6 Drawing Sheets

FIG. 1
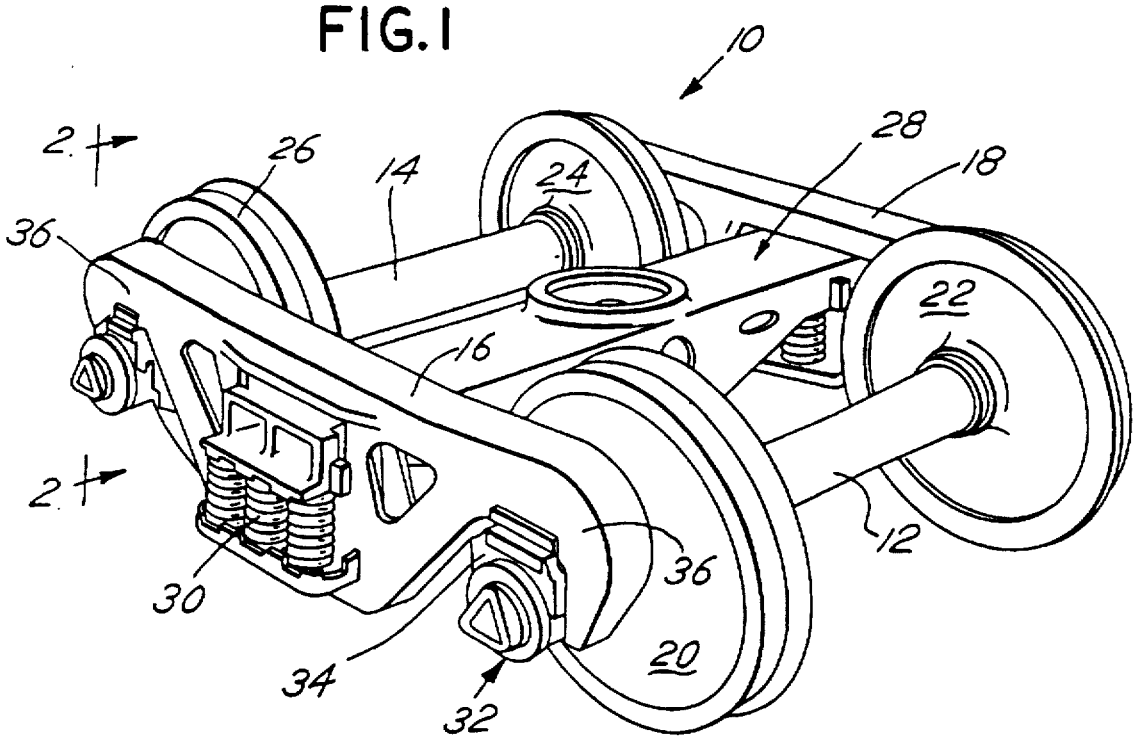
FIG 4
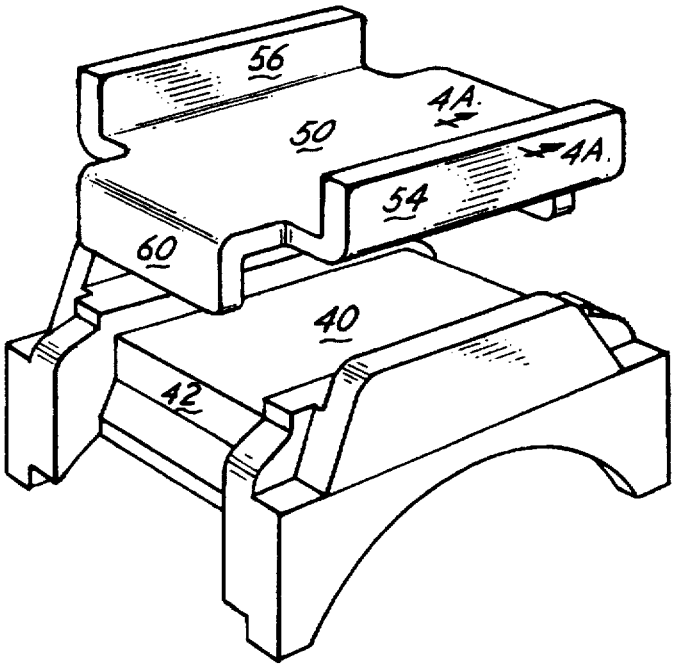
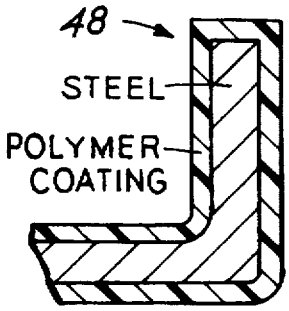
FIG. 4A

FIG. 2
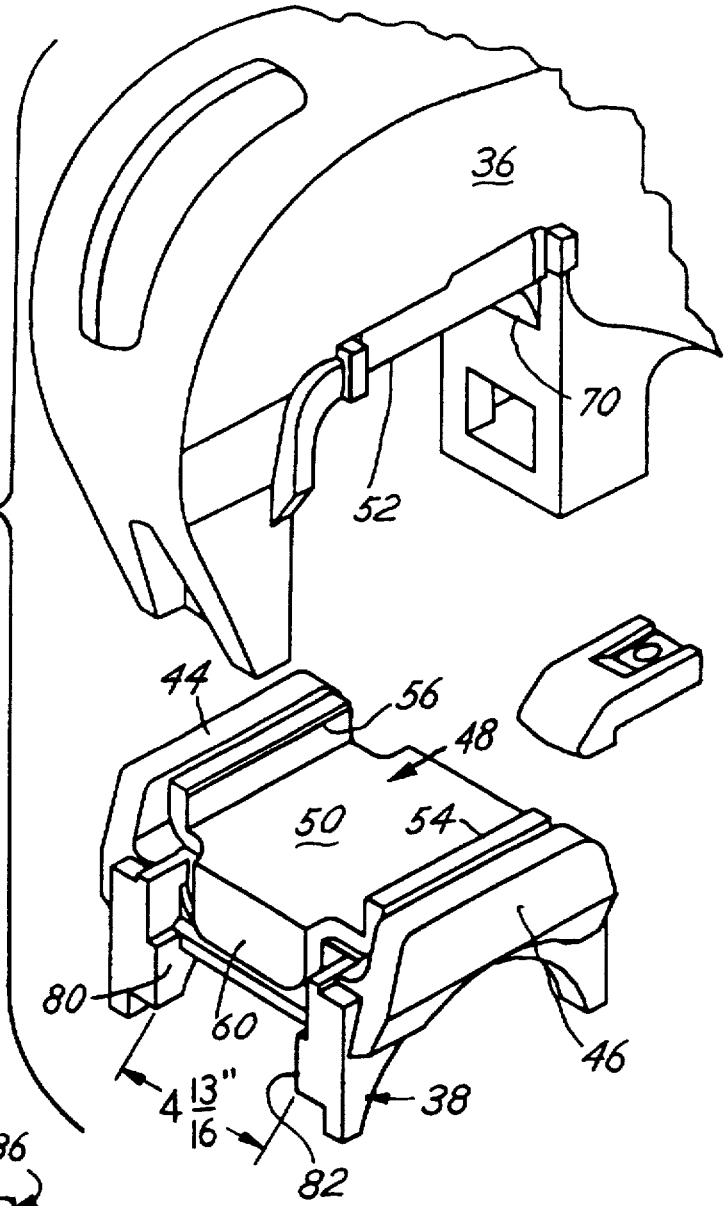
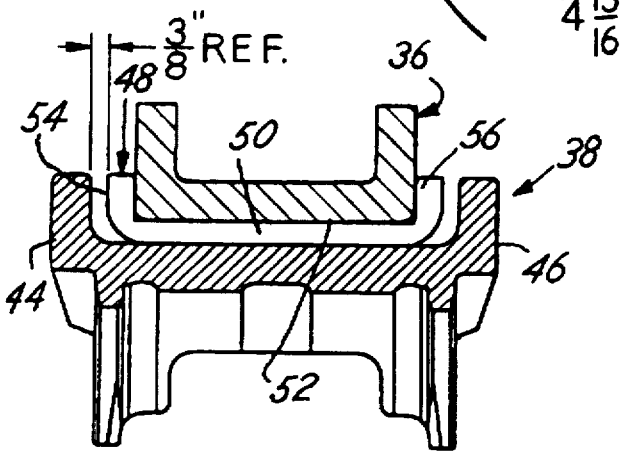
FIG. 3

FIG. 5
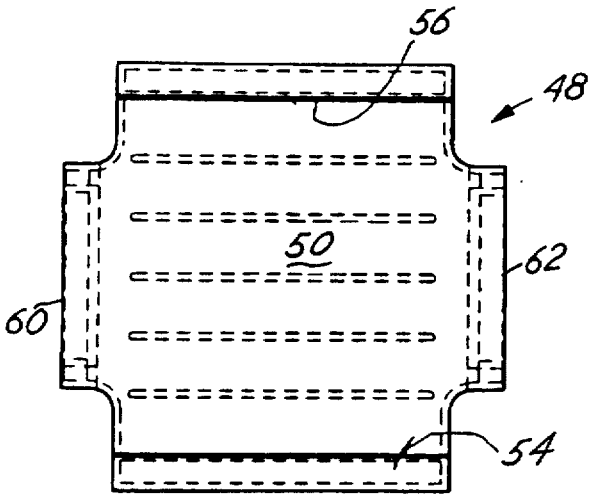
FIG. 7
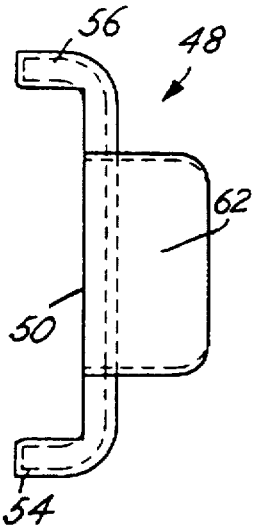
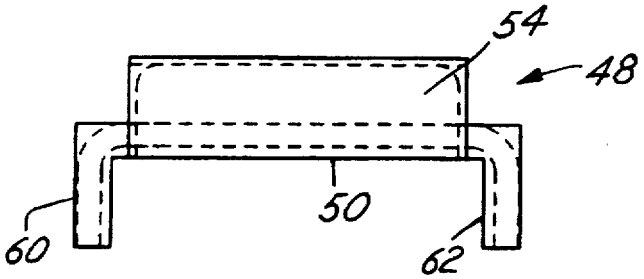
FIG. 6

FIG.9
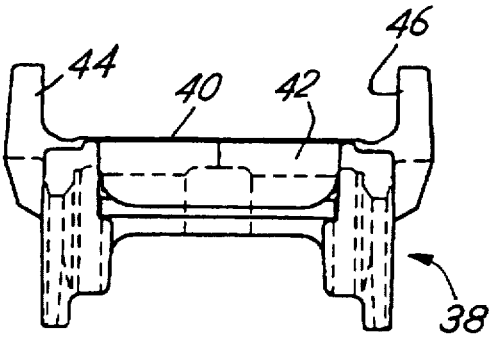
FIG.8
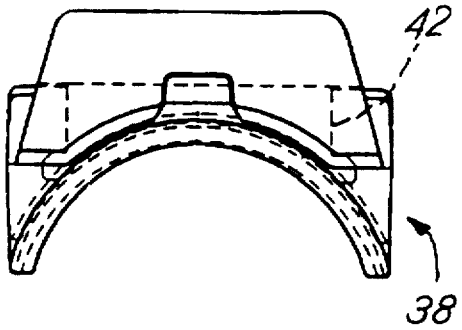
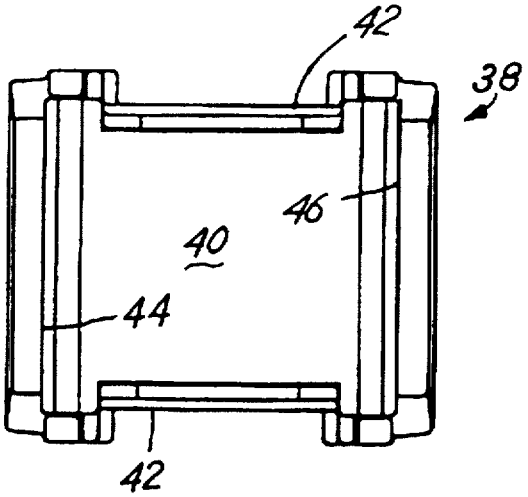
FIG.10

FIG. 11
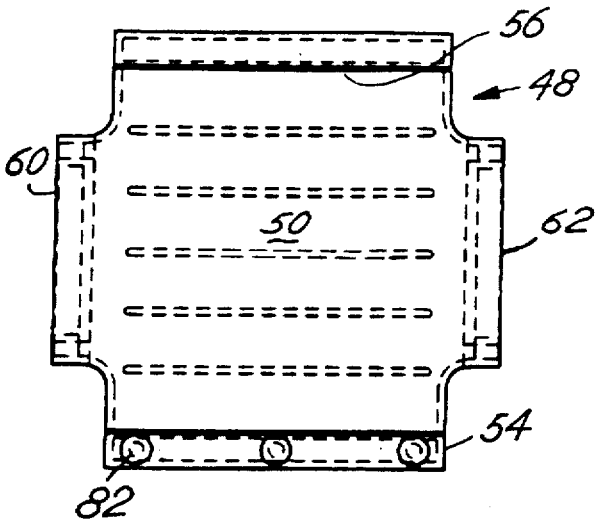
FIG. 12
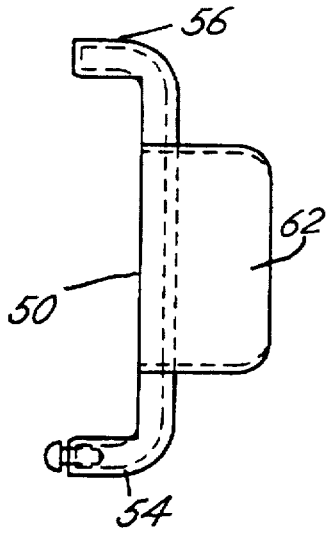
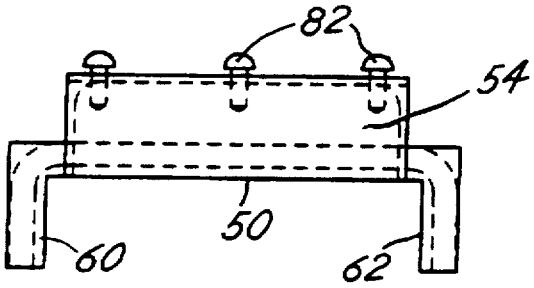
FIG. 13
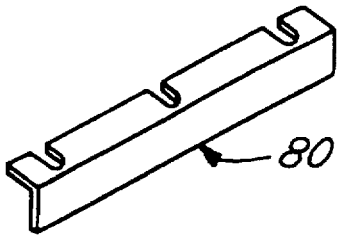
FIG. 14
THREE SHIMS ONE EACH 1/16", 1/8" AND 3/16" SLOTS LOCK IN DRIVE STUDS ON PAD, ONE SIDE ONLY FIG. 15
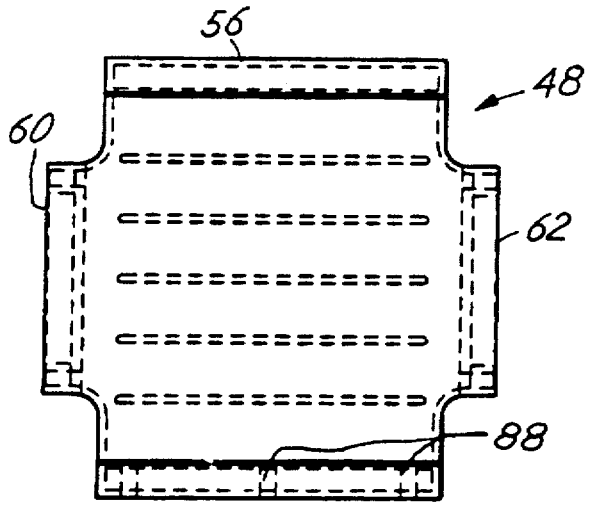
FIG. 16
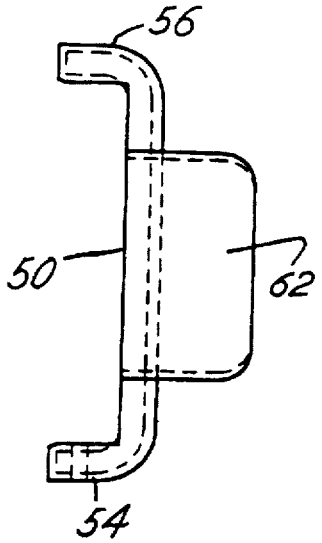
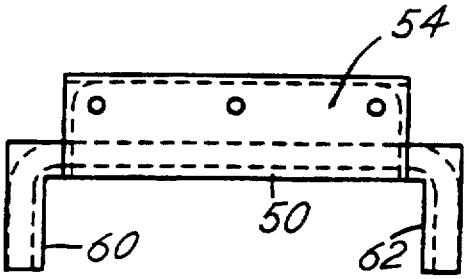
FIG. 17
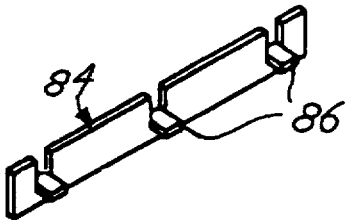
FIG. 18
THREE SHIMS ONE EACH 1/16", 1/8" AND 3/16" TABS INTERLOCK IN HOLES ON PAD, ONE SIDE ONLY

BEARING ADAPTER AND ADAPTER PAD FOR RAILWAY TRUCKS

BACKGROUND OF THE INVENTION

Field of the Invention

The present invention relates to a freight car truck, and in particular to the pedestal area where the axle and bearing are loosely journaled to the side frame.

A common phenomenon with railcar trucks is referred to as truck hunting, which is a swiveling action of the truck while running down a track. Hunting is a consequence of the evolution of the friction bearings being replaced by roller bearings, the latter reducing the axial movements of the wheel set, and also a consequence of increased operating speeds.

With reduced lateral movement in the wheel set, contact to the side frame thrust lugs is achieved quickly, and the resulting force is transmitted through the side frame to the bolster and then to the car body. Excessive hunting causes high lateral accelerations creating wear to the truck components as well as the track. The foregoing is also a cause of lading damage.

There have been attempts at increasing the lateral movement of the wheel set relative to the side frame through the use of elastomeric shear pads in the pedestal area and increased openings in the thrust lug area. Such an approach is disclosed in Jones U.S. Pat. No. 3,381,629. However, the foregoing known approach has not been successful.

Our U.S. Pat. No. 5,404,826 discloses an arrangement comprising an adapter and adapter pad which can slip, allowing the wheel set lateral movement without contact to the side frame thereby lessening the damaging forces, while still achieving running speeds which may approach 80 miles per hour, a substantial increase over conventional railcars. The foregoing patent discloses a system which precludes the need for constant contact side bearings so as to afford initial savings and reduced maintenance.

The preferred embodiment disclosed in FIG. 9 of the '826 patent includes a pedestal liner 50' which mounts under the pedestal portion of the side frame and includes depending end walls 102 and 104 which have end portions bent outwardly to create tabs shown at 106, 108, 110 and 112 (see FIG. 11). When the pedestal liner 50' is mounted with the flat portion 100' bearing up against the wall 40' which defines the top of the pedestal opening, the depending end wall 104 together with the outwardly bent tabs 110 and 112 will cover the thrust lug 48' (see FIG. 9).

In a similar manner, the depending wall 102 together with the outwardly bent tabs 106 and 108 will cover the opposed thrust lug 48' (not shown). As a result, the thrust lugs are protected from wear and the portions of the pedestal liner 50' which cover the thrust lugs 48' will facilitate lateral sliding movement of the adapter 34' relative to the side frame pedestal 36'. The pedestal liner 50' is old in the art and is shown in U.S. Pat. No. 4,785,740.

The structure shown in FIG. 9 of the '826 patent also includes an adapter 34' and an adapter plate 56'. The adapter plate 56' fits down over the adapter 34' and is fixed relative thereto. The adapter 34' has opposed end openings 66' formed in each end which openings are defined by opposed shoulders 68' and 70'. When the foregoing components are assembled, the thrust lugs 48' in the pedestal opening fit down into the adapter openings 66'. Because the distance between the shoulders 68' and 70' is deliberately made greater than the lateral width of the thrust lugs 48' (including the thickness of the tabs 106 and 108), lateral movement is permitted between the adapter, axle and wheels on the one hand, and the side frame 36' on the other hand.

In the foregoing known embodiment, the intermediate member or adapter plate 56' has depending end portions 58' and 60' which overlie the longitudinal ends of the adapter 34' when the adapter plate is pressed down against the top of the adapter 34'. In a preferred embodiment, the foregoing adapter plate 56' has a urethane coating so as to facilitate sliding movement between the adapter 34' and the pedestal liner 50' while protecting the adapter from wear.

The structure disclosed in our U.S. Pat. No. 5,404,826 as described above offers important advantages. However, in certain heavy duty applications, the pedestal liner 50' may become damaged. In that known embodiment, there is no relative movement between the pedestal liner 50' and the pedestal portion 36' of the side frame, and there is no relative movement between the adapter plate 56' and the adapter 34' because the depending end walls 58' and 60' fit closely between the shoulders 68' and 70'. However, because the shoulders 68' and 70' are spaced further apart than the width of the thrust lugs 48' (including the thickness of the tabs 106 and 108 which cover the sides of those thrust lugs), the desired relative lateral movement occurs because the adapter 34' and adapter plate 56' on the one hand can slide laterally relative to the side frame 36' and pedestal liner 50' on the other hand.

Such relative lateral movement is limited when one of the tabs 106 or 108 engages against one of the shoulders 68' or 70' on the adapter. When the loads are quite heavy, such engagement between the tabs of the pedestal liner and the adapter shoulders can cause significant damage to the tabs in part because of the relatively small surface area of engagement, and also because the pedestal liner 50' is a relatively thin member. When such damage does occur, the tabs can break off and the entire pedestal liner can become dislodged which will then cause direct sliding contact between the top of the adapter plate 56' and the roof of the pedestal opening, which is undesirable.

It is an object of the present invention to provide improved components which avoid the problem discussed above with respect to the known '826 arrangement.

Another object is to eliminate the relatively thin pedestal liner 50' and provide two components to substitute for the three components described above comprising the pedestal liner, the adapter plate and the adapter.

A related object is to provide an improved adapter, and an adapter pad which attaches to the roof of the pedestal opening and sits on the top of the adapter, the foregoing components being designed to permit relative lateral movement between the adapter pad and the adapter.

Still another of our objects is to provide a relatively rigid adapter pad which is made of steel and has a polymer coating, and to provide an adapter having a machined top surface for sliding movement relative to the polymer-coated adapter pad.

The foregoing and other objects and advantages of our invention will be apparent from the following description of a preferred embodiment thereof, taken in conjunction with the accompanying drawings.

DESCRIPTION OF THE DRAWINGS

FIG. 1 is a perspective view of a truck assembly including adapter assemblies constructed in accordance with the present invention;

FIG. 2 is an exploded perspective view showing a pedestal portion of a side frame and the assembly of an adapter and an adapter pad;

FIG. 3 is a vertical sectional view showing a portion of the bearing adapter assembled in the pedestal opening with the adapter pad positioned between the roof of the pedestal opening and the top of the bearing adapter;

FIG. 4 is a schematic, exploded, perspective view showing an adapter constructed in accordance with the present invention together with an adapter pad for positioning between the adapter and the roof of a pedestal opening;

FIG. 5 is a top plan view of an adapter pad or pedestal plate constructed in accordance with the present invention;

FIG. 6 is an end elevational view of the adapter pad of FIG. 5;

FIG. 7 is a side elevational view of the adapter pad of FIG. 5;

FIG. 8 is an end elevational view of an adapter constructed in accordance with the present invention;

FIG. 9 is a side elevational view of the adapter of FIG. 8;

FIG. 10 is a top plan view of the adapter of FIG. 8;

FIG. 11–14 illustrate an adapter pad and the manner of using a shim which is attached to one side of the adapter pad by three studs to enable laterally spaced, upright walls of the adapter pad to fit closely over laterally spaced sides of the side frame pedestal roof; and FIGS. 15–18 are similar to FIGS. 11–14 and show an alternative embodiment where instead of using studs to attach the shims, there are provided three rectangular tabs which project into rectangular openings in an upright wall of the adapter pad.

Now, in order to acquaint those skilled in the art with the manner of making and using our invention, we shall describe, in conjunction with the accompanying drawings, a preferred embodiment of the invention.

DETAILED DESCRIPTION OF THE INVENTION

FIG. 1 shows a truck assembly 10 including a pair of axles 12 and 14, a pair of side frames 16 and 18, four wheels 20, 22 24 and 26, and a bolster 28 which extends between the side frames with its opposed ends projecting into openings in the side frames to be supported on spring assemblies shown at 30. The truck assembly 10 further includes four bearings 32, each having an adapter assembly 34 disposed between the bearings and the underside of a pedestal portion 36 of the side frame.

FIG. 4 and FIGS. 8–10 show an adapter 38 constructed in accordance with the present invention for mounting on one of the three bearing assemblies shown at 32 in FIG. 1. The adapter 38 includes a top wall 40 which is flat and is machined to be suitable for sliding contact with the underside of an adapter pad or pedestal plate 48 to be described hereinafter. The adapter 38 further includes a pair of opposed end surfaces 42 which are also machined to facilitate sliding contact with the adapter pad 48. The adapter 38 further includes longitudinal walls 44 and 46 which are raised well above the flat surface 40 and arranged in spaced, parallel fashion to receive between them the adapter pad 48 which can slide laterally relative to the adapter 38.

FIGS. 4–7 show the adapter pad or pedestal plate 48 having a flat, horizontal wall 50. The upper surface of the wall 50 is designed to fit snugly against the roof 52 of the pedestal opening as shown in FIG. 3, and the lower surface of the wall 50 is designed to fit closely against the top surface 40 of the adapter 38 for sliding movement relative thereto.

The adapter pad 48 further includes a pair of parallel, upright longitudinal walls 54 and 56 which are designed to fit against axially opposed sides of the roof 52 of the pedestal opening as shown in FIG. 3. In order to assure that the opposed upright walls 54 and 56 of the adapter pad 48 fit snugly against the opposed sides of the pedestal roof 52, it may be desirable to provide shims along the inside of one of the upright walls 54 and 56, as will be described later herein. When using a thin, flexible pedestal liner such as shown at 50 in FIG. 3 of our U.S. Pat. No. 5,404,826, such shims are not necessary since the flexibility of the liner permits it to be snapped up into position. However, the adapter pad or pedestal plate 48 of the present invention is a relatively rigid member so it must be made to fit accurately.

The adapter pad 48 also is provided with a pair of longitudinally spaced depending end walls 60 and 62 which when assembled depend down adjacent the opposed, machined end surfaces 42 on the adapter 38 as shown in FIG. 2. As a result, the adapter pad or pedestal plate 48 is prevented from longitudinal movement relative to the adapter 38. However, relative lateral movement between the adapter pad 48 and the adapter 38 is permitted to achieve the objective of permitting relative lateral or axial movement between the adapter, axle and wheels on the one hand and the side frame 36 on the other hand.

Such lateral movement is permitted because the upright, parallel walls 44 and 46 of the adapter 38 are spaced laterally apart a predetermined amount such as ¾th inch more than the spacing of the upright, parallel walls 54 and 56 of the adapter pad 48. As a result, the adapter pad 48 may be moved laterally in one direction relative to the adapter 38 until adapter pad wall 54 abuts adapter wall 44 and may be moved laterally in the opposite direction relative to adapter 38 until adapter pad wall 56 engages adapter wall 46.

Because the surface area of contact between walls 54 and 56 and walls 44 and 46 is relatively large compared to the tabs shown at 106 and 108 in FIG. 9 of our U.S. Pat. No. 5,404,826, and because the adapter pad 48 is relatively rigid compared to the pedestal liner shown at 50' in FIG. 9 of the '826 patent, there is little danger of the adapter pad 48 being damaged as it slides back and forth relative to the adapter 38. Thus, a major potential problem with the prior design has been solved, and in addition one of the components of the prior design has been eliminated. In accordance with the present invention, only a single component is required between the adapter 38 and the pedestal roof 52.

Referring again in FIG. 4, there is included a schematic showing of the adapter pad 48 to illustrate a steel interior and an outer polymer coating. The foregoing is highly desirable for the composition of the adapter pad 48 because the interior steel affords the desired strength while the polymer coating facilitates the sliding contact between the underside of the polymer pad 48 and the machined top surface 40 of the adapter 38.

Comparing the present design with the design of the '826 patent, in the former design the liner 50' was fixed to the pedestal 36', the adapter plate 56' was fixed to the adapter 34', and the adapter 34' was permitted to move laterally relative to the side frame pedestal 36'. In the present design, the adapter pad 48 is fixed relative to the side frame pedestal 36, but the adapter pad 48 is permitted to move laterally relative to the adapter 38.

The present invention comprising the combination of the adapter pad 48 and the adapter 38 affords important advantages over the prior art. The pedestal 36 of the side frame is protected against wear because it is contacted only by the adapter pad or pedestal plate 48 which is polymer coated and is stationary relative to the side frame pedestal 36. Moreover, the desired relative lateral movement is not limited, as in our U.S. Pat. No. 5,404,826, by having the tabs 106 and 108 which cover the sides of the thrust lugs 48' (see FIG. 9 of the patent), abut against shoulders 68' and 70' of the adapter. Instead, much larger surfaces are utilized to limit the relative lateral movement, such surfaces being the raised parallel walls 44 and 46 on the adapter 38 (see FIG. 2) and the raised, parallel walls 54 and 56 on the adapter pad or pedestal plate 48.

Because those engaging walls provide relatively large surface areas for contact, they are less subject to damage. In addition, the adapter pad 48 is a relatively rigid member compared to the pedestal liner shown at 50' in the '826 patent. A further advantage is that during relative lateral movement between the adapter pad 48 and the adapter 38, the polymer coated bottom surface of the adapter pad wall 50 slides on the machined surface 40 of adapter 38 which facilitates such relative movement and reduces any risk of damage. Also, there is no metal-to-metal contact when the adapter pad walls 54 and 56 engage against the adapter walls 44 and 46 due to the polymer coating on the adapter pad 48. The present invention functions with a standard side frame, but both the adapter pad 48 and the adapter 38 are novel.

In the foregoing design, the depending legs 60 and 62 on the adapter plate 48 protect the thrust lugs, one of which is partially shown at 70 in FIG. 2 (best shown at 48 in FIG. 5 of our U.S. Pat. No. 5,404,826).

As described in the '826 patent, the present invention is designed to permit three-fourths inch of relative lateral movement between the adapter pad 48 and the adapter 38 for the purpose of permitting that same amount of relative lateral movement between the adapter, axle and wheels on the one hand and the side frame 36 on the other hand. FIG. 3 shows that in a centered position the spacing between adjacent walls or rails 44 and 48 is ⅜ths inch, and the same spacing is provided between the adjacent walls or rails 46 and 56. Such spacing, which of course may be varied, provides the desired relative lateral movement of three-fourths inch as described earlier herein.

FIG. 2 shows that the spacing between shoulders 80 and 82 on the adapter 38 is 4 13/16 inches. The foregoing dimension is larger than the dimension of 4 9/16 inches described in our U.S. Pat. No. 5,404,826 (see col. 5, lines 10–12). In both cases, the intent is to provide three-fourths inch relative lateral movement, but in the present case the rails 44 and 56 and 46 and 54 function as lateral stops, so the distance between shoulders 80 and 82 is made large enough to permit the desired relative movement of the thrust lugs 70 between the shoulders 80 and 82 without engagement therebetween.

Reference is again made to the manner in which the adapter pad or pedestal plate 48 attaches to the roof of the side frame pedestal 36 by means of the upwardly extending rails 54 and 56 fitting over the opposed lateral sides of the pedestal roof 52. It is desired that the fit-up between the side frame 36 and adapter pad 48 be close. This result could be accomplished by grinding either part, but that would prove costly. Another solution would be to provide adapter pads 48 of various widths, but that is not believed desirable. In accordance with our preferred embodiment, we provide shims to the adapter pad 48. A further method could be a taper shim. It would also be possible to weld the adapter pad 48 to the pedestal roof of the side frame 36, but that would be costly and would preclude easy maintenance.

Reference is now made to FIGS. 11–14 which illustrate the adapter plate 48 having a shim attached to the inside of one of the upright walls 54 and 56 to aid in providing a close fit between those walls and the sides of the pedestal roof 52. There is shown a shim 80 which is attached to the inside of one upright wall of the adapter pad by three studs 82 which are driven in place and not intended to be removed. In accordance with our invention, three different sizes of shims are provided.

FIGS. 15–18 show an alternative embodiment where a shim 84 having rectangular tabs 86 formed thereon is attached to the inside of an upright wall of the adapter plate 48 by snapping or pressing the tabs 86 into rectangular openings 88 formed in the side of the upright wall of the adapter pad.

What is claimed is:

1. In a railway car truck assembly including a wheel set, a pair of axles, a pair of side frames, and a truck bolster, each side frame having a pedestal opening at each end thereof, a pair of opposed thrust lugs located on pedestal walls which define each said pedestal opening in positions proximate a roof of said pedestal opening, and a bearing assembly on each end of each axle positioned in a corresponding side frame pedestal opening for mounting said side frame on an end of a corresponding axle, the improvement comprising, in combination, an adapter pad to be fixedly secured to said roof of said pedestal opening to underlie said roof and be fixed relative to said side frame, and an adapter to be positioned on top of said bearing assembly, said adapter pad being slidably positioned on top of said adapter, first stop means on said adapter pad for limiting lateral sliding movement thereof relative to said adapter, and second stop means on said adapter for engagement with said first stop means to limit said relative lateral sliding movement between said adapter pad and said adapter, said first and second stop means being spaced apart a predetermined distance to permit predetermined relative lateral sliding movement between said adapter pad and said adapter, and said thrust lugs being positioned between opposed shoulders on said adapter and said shoulders being spaced sufficiently so said thrust lugs do not engage said shoulders during said lateral sliding movement between said adapter pad and said adapter.

2. The invention defined in claim 1 where said first stop means comprises a pair of laterally spaced, elongated, longitudinal walls which extend upwardly from opposed sides of said adapter pad and serve as said first stop means and also serve to fixedly secure said adapter pad to said roof of said pedestal opening by engaging over laterally spaced sides of said roof.

3. The invention defined in claim 2 where said adapter pad includes longitudinally spaced, depending end walls which depend down over corresponding end walls of said adapter to prevent relative longitudinal movement between said adapter pad and said adapter.

4. The invention defined in claim 3 where said adapter pad is made of steel and has a polymer coating outside of the steel.

5. The invention defined in claim 2 where a shim is attached to an inside of one of said walls to provide for a close fit when said pair of walls engage over said laterally spaced sides of said roof.

6. The invention defined in claim 3 where a shim is attached to an inside of one of said walls which extend upwardly to provide for a close fit when said walls which extend upwardly engage over said laterally spaced sides of said roof.

7. The invention defined in claim 1 where said second stop means comprises a pair of laterally spaced, elongated, longitudinal walls which extend upwardly from said adapter.

8. The invention defined in claim 7 where a top surface of said adapter is machined to facilitate sliding movement between said adapter pad and said adapter.

9. In a railway car truck assembly including a wheel set, a pair of axles, a pair of side frames, and a truck bolster, each side frame having a pedestal opening at each end thereof, a pair of opposed thrust lugs located on pedestal walls which define each said pedestal opening in positions proximate a roof of said pedestal opening, and a bearing assembly on each end of each axle positioned in a corresponding side frame pedestal opening for mounting said side frame on an end of a corresponding axle, the improvement comprising, in combination, an adapter pad to be fixedly secured to said roof of said pedestal opening to underlie said roof and be fixed relative to said side frame, and an adapter to be positioned on top of said bearing assembly, said adapter pad being slidably positioned on top of said adapter, a first pair of laterally spaced, elongated, longitudinal walls parallel to one another and extending upwardly from said adapter pad for fixedly attaching said adapter pad to said roof of said pedestal opening by engaging over laterally spaced sides of said roof, a second pair of laterally spaced, elongated, longitudinal walls parallel to said first pair of walls and extending upwardly from said adapter, said second pair of walls being located laterally outwardly of said first pair of walls whereby when said adapter pad slides laterally in one direction relative to said adapter, one of said first pair of walls will engage one of said second pair of walls to limit such relative lateral movement, and when said adapter pad slides laterally in a second opposite direction relative to said adapter a second one of said first pair of walls will engage a second one of said second pair of walls to limit such relative lateral movement, said second pair of walls being spaced laterally outwardly from said first pair of walls a predetermined distance to permit predetermined relative lateral sliding movement between said adapter pad and said adapter, and said thrust lugs being positioned between opposed shoulders on said adaptor and said shoulders being spaced sufficiently so said thrust lugs do not engage said shoulders during said lateral sliding movement between said adapter pad and said adapter.

10. The invention defined in claim 9 where said adapter pad is made of steel and has a polymer coating outside of the steel.

11. The invention defined in claim 9 where a top surface of said adapter is machine to facilitate sliding movement between said adapter pad and said adapter.

12. The invention defined in claim 9 where a shim is attached to an inside of one of said first pair of walls to provide for a close fit when said first pair of walls engage over said laterally spaced sides of said roof.

* * * * *